US009980529B1

(12) United States Patent
Hajianpour

(10) Patent No.: US 9,980,529 B1
(45) Date of Patent: May 29, 2018

(54) HELMET/HOOD ASSEMBLY WITH AN ACCESSORY LIGHT

(71) Applicant: Mohammed Ali Hajianpour, Fort Lauderdale, FL (US)

(72) Inventor: Mohammed Ali Hajianpour, Fort Lauderdale, FL (US)

( * ) Notice: Subject to any disclaimer, the term of this patent is extended or adjusted under 35 U.S.C. 154(b) by 317 days.

(21) Appl. No.: 14/738,215

(22) Filed: Jun. 12, 2015

(51) Int. Cl.

| | |
|---|---|
| ***A42B 3/04*** | (2006.01) |
| ***A42B 3/22*** | (2006.01) |
| ***F21V 21/096*** | (2006.01) |
| ***F21L 4/04*** | (2006.01) |

(52) U.S. Cl.
CPC ..... *A42B 3/044* (2013.01); *A42B 3/225* (2013.01); *F21L 4/045* (2013.01); *F21V 21/0965* (2013.01)

(58) Field of Classification Search
CPC ..... A42B 3/045; A42B 3/225; F21L 4/045; F21V 21/0965
See application file for complete search history.

(56) References Cited

U.S. PATENT DOCUMENTS

| | | | | |
|---|---|---|---|---|
| 4,605,292 | A * | 8/1986 | McIntosh | A47G 1/00 248/205.3 |
| 2014/0352037 | A1* | 12/2014 | VanDerWoude | A41D 13/1153 2/410 |
| 2017/0000207 | A1* | 1/2017 | Hajianpour | A42B 3/145 |

* cited by examiner

*Primary Examiner* — Stephen F Husar
(74) *Attorney, Agent, or Firm* — Ronald V. Davidge

(57) ABSTRACT

A helmet/hood assembly includes a housing, a support ring subassembly configured to hold the assembly on a human head, a face shield, and a flexible hood attached to the housing and to the face shield, with the assembly being received, stored, used, and disposed as a single unit. The support ring subassembly pivots on the housing between a position suitable for shipping and storing the assembly and a position in which the assembly is worn. An accessory light powered by a battery may be held in place on the housing by magnetic attraction through the hood.

19 Claims, 6 Drawing Sheets

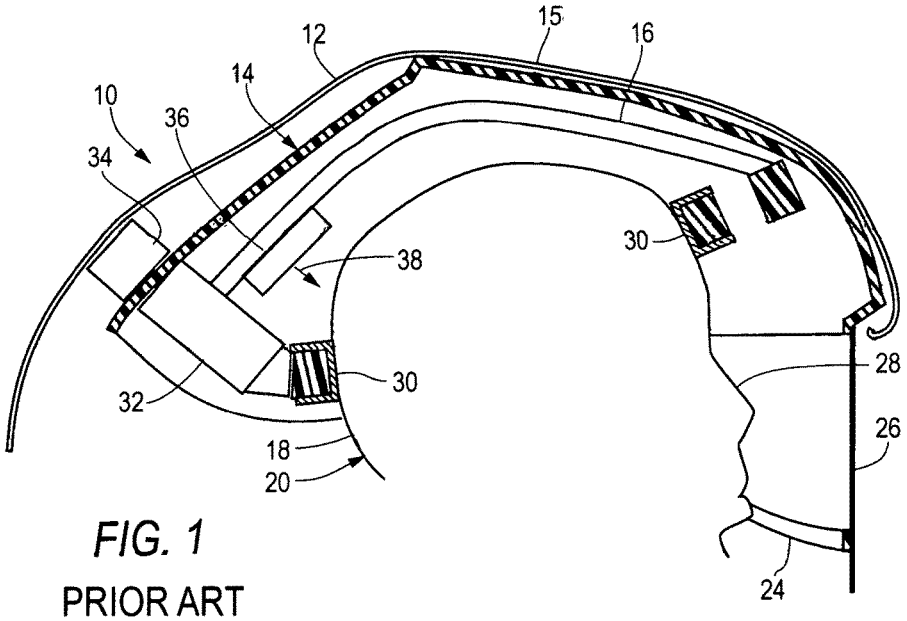
FIG. 1
PRIOR ART
FIG. 2
PRIOR ART
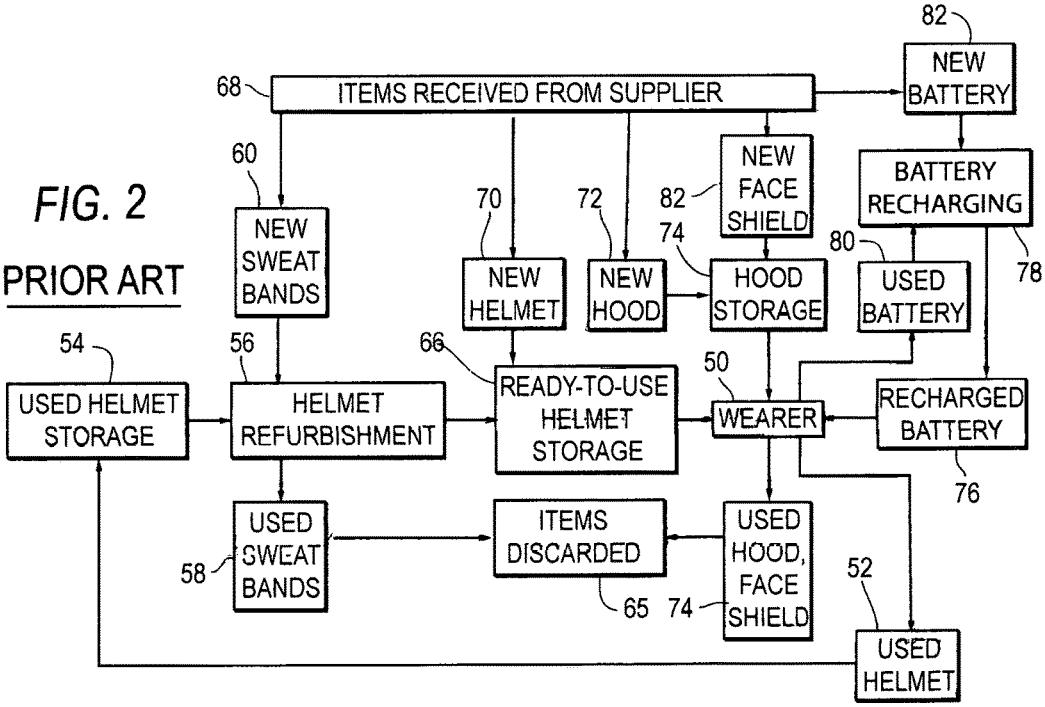

FIG. 6
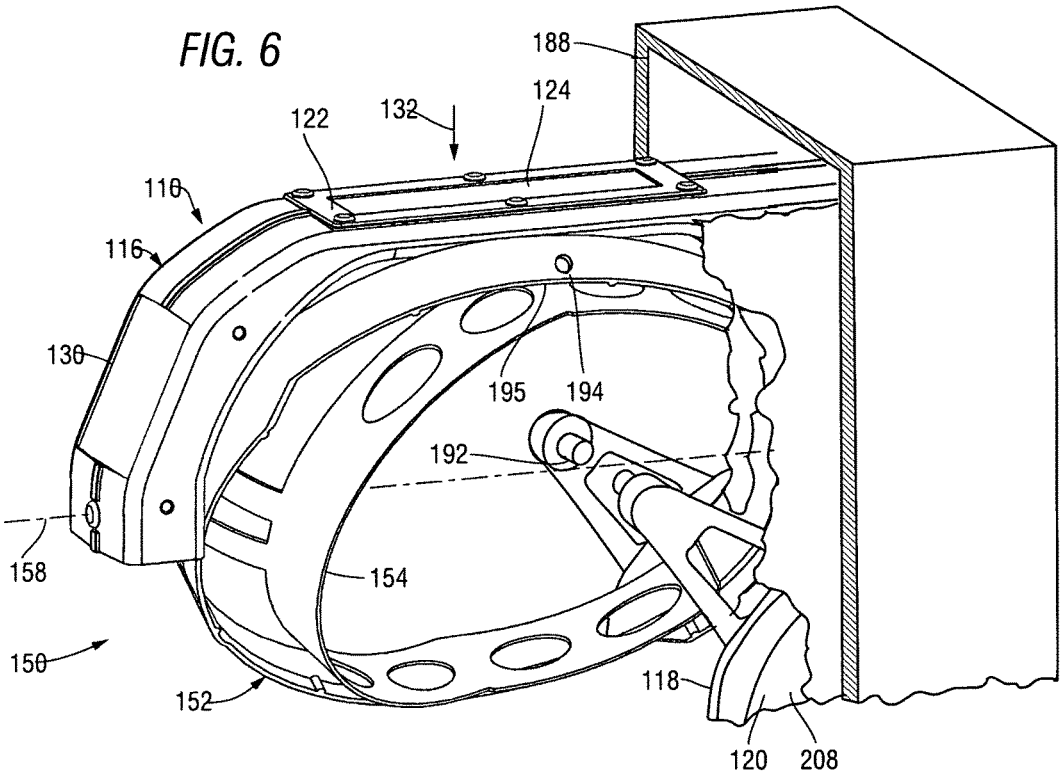
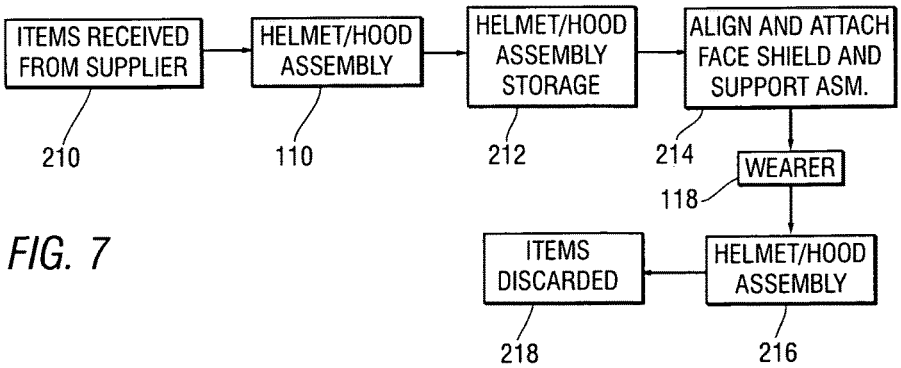
FIG. 7

HELMET/HOOD ASSEMBLY WITH AN ACCESSORY LIGHT

RELATED APPLICATIONS

This is a continuation-in-part of U.S. patent application Ser. No. 14/605,213, filed Jan. 26, 2015.

FEDERALLY SPONSORED RESEARCH OR DEVELOPMENT

Not Applicable

BACKGROUND OF THE INVENTION

1. Field of the Invention

This invention relates to a helmet/hood assembly to be worn by surgical personnel and, more particularly, to such a helmet/hood assembly having a structure and assembly process configured to provide for a significantly reduction in the space required for storing the helmet/hood assembly.

2. Summary of the Background Information

For thousands of years, people have made and worn various types of helmets to provide protection of the head from physical injury in war, sports, various occupations, and in forms of transportation, such as riding a bicycle or motorcycle, in which the head is exposed. When a suitable helmet was worn, the head was protected against blunt trauma, cutting edges, and projectiles, with helmets being strong, rigid, and designed to extend over the entire head. In the 1960's and 1970's it became apparent that a different kind of helmet was needed to protect operating room personnel and patients undergoint surgical procedures from contamination by one another. Specifically, a system was needed to provide separate airspaces in which each of the operating room personnel would breath and in which the surgical procedure would occur, so that the surgical site would not be contaminated by airborne contaminates exhaled or otherwise expelled by the operating room personnel, and additionally so that the operating room personnel will not be contaminated by blood splatter and other airborne contamination from the surgical site.

This need has been filled by a number of types of ventilated helmet/hood systems, each including a flexible hood, a transparent face shield, and a rigid helmet extending under the flexible hood to hold the flexible hood in place. Initially, air was supplied to a space within the helmet through a flexible hose from supply of clean air. However, since the air supply connections through hoses placed too many limitations on the movements of the operating room personnel, a portable air supply was developed, with an electrically-driven fan attached to the waist of each operating room person drawing air from behind his back, and with the air being supplied to his helmet through a flexible tube.

Then, circa 1975, the fan was instead placed within the helmet, forming a type of system shown in the schematic view of FIG. 1 that has become widely used as the conventional ventilated helmet/hood apparatus 10 for operating room personnel. The helmet/hood apparatus 10 includes a flexible hood 12 placed over a helmet 14, which supports the hood 12, giving its top portion 15 shape. The helmet 14 in turn includes a support assembly 16 configured for engaging the head 18 of the wearer 20, a housing 22, and a frame 24 configured for holding a transparent face shield 26 in front of the face 28 of the wearer 20. The support assembly 16 includes replaceable sweat bands 30 that are configured to be held against the head 18 and an adjustment mechanism 32 that adjusts the spacing between the sweat bands 20 to fit the head 48 in response to the rotation of an adjustment knob 34. Both the sweat bands 30 and the face shield 26 are replaced after each use, being adhesively attached within the helmet 14. The apparatus 10 further includes a fan 36 moving air in the direction of arrow 38 within the helmet 14.

A first limitation of the conventional approach using the helmet/hood apparatus 10 arises from the fact that the helmet 18 has been designed as a traditional helmet that completely surrounds the head of the wearer, protecting the head from injury due to blows. Therefore, the helmet 18 is unnecessarily large, resulting in increased costs for shipping and storage, and heavy, resulting in added discomfort for the wearer.

A second limitation of the conventional approach using the helmet/hood apparatus 10 arises from the fact that, while structures within the helmet 14 may include slots 36 allowing air movement, there are no openings within the upper portion 15 of the hood 12 through which fresh air can be drawn, or through which air may be exhausted. While some air is allowed to move inward and outward through spaces between the body of the wearer 20 and a lower edge (not shown) of the hood 12, a lack of air paths through the upper portion 15 of the hood implies that the vast majority of the air moved by the fan 36 is being recirculated within the helmet/hood apparatus 10 as levels of carbon dioxide within the apparatus 10 are allowed to rise, resulting in a possible reduction in the level of the technical skills of the medical personnel wearing the apparatus 10.

A third limitation of the conventional approach using the helmet/hood apparatus 10 arises from the fact that the adjustment knob 34 is located at the rear of the helmet 14. If the wearer 20 determines that the support assembly 16 is too loose or too tight, he cannot remove one of his hands from the sterile field to reach the knob 24 behind his head. He must instead have another individual perform the adjustment.

The helmet 14 is conventionally reused by other users 20 in other surgical procedures, while the hood 12 and face shield 26, which are each directly exposed to contamination by blood splatter during surgery, and the sweat bands 30 are replaced following each use of the helmet/hood 10. A rechargeable battery, attached to the wearer 20 by a belt, is connected to the helmet 14 power the fan 36.

FIG. 2 is a schematic view of the flow of parts within a hospital to provide helmet/hood apparatus as needed for operating room personnel. In this process, the vast majority of the helmets that are provided for operating room personnel, indicated as wearers 50, begin as used helmets 52, which are stored in a helmet storage area 54 and refurbished in an area 56, with the refurbishment process replacing used sweat bands 58 with new sweat bands 60 and including cleaning the used helmets, with a refurbished helmet being then placed in ready-to-use helmet storage 66. The new sweat bands 60 are obtained from one or more suppliers, indicated herein as 68. New helmets 70 can also be obtained in this way for placement in ready-to-use helmet storage 68. New hoods 72 and new face shields 73 are additionally obtained from suppliers 68, being attached to one another and placed in hood storage 74. Since hoods and face shields are not reused, used hoods and face shields 74 are discarded at 65.

As a wearer 50 is prepared for surgery, a helmet from ready-to-use helmet storage 66 is placed on his head and adjusted to fit using the adjustment knob 34. Then, a hood from hood storage 74 is placed over the helmet and over his shoulders. After the gown is placed on the wearer 50, since electrical power is required to operate the fan 36, a rechargeable battery 76, having been taken from a battery recharging area 78, is placed in the pocket of the gown worn by the wearer 50 or otherwise attached to his clothing and electrically connected to the fan 36. After the surgical procedure is completed, the wearer 50 removes the used helmet 52, which is returned to used helmet storage 54, the used hood and face shield 74, which are discarded at location 65, and a used battery 80, which is then stored and recharged at the recharging station 78, New batteries 82 may additionally be obtained from a supplier at 68 and placed into the recharging station 78.

A fourth limitation of the conventional approach using the helmet/hood apparatus 10 arises from the complexity of the process for preparing the apparatus 10 for use, with the replaceable items, the hood 12, face shield 26, and sweat pads 30 being separately received and installed, and with significant space being devoted to the storage and refurbishment of used helmets.

A fifth limitation of the conventional approach using the helmet/hood apparatus 10 arises from the fact that, the remaining portions of the helmet 14 are reused by multiple people, often additionally in multiple locations within a large facility, flying rise to a possibility of various kinds of cross-contamination. Including the spreading of disease from one location to another and among patients and hospital workers coming into contact with the used helmets.

A sixth limitation of the conventional approach using the helmet/hood apparatus 10 arises from the use of rechargeable batteries, which limits the use of the apparatus 10 to areas where electricity is available for recharging the battery, providing particular problems in remote areas and in disaster areas.

SUMMARY OF THE INVENTION

In accordance with one aspect of the invention, apparatus including a helmet/hood assembly and an accessory light is provided. In accordance with another aspect of the invention, an auxiliary light is provided, being configured for attachment to the helmet. The helmet, is configured to support the apparatus on a human head, with the helmet including a front helmet portion with a front helmet attachment structure and a rear portion with a rear helmet attachment structure, The auxiliary light includes a front housing holding an illumination source powered by electricity and a front housing attachment structure, a rear housing holding a rear housing attachment structure, with a central frame extending between the front and rear housings and attaching the front and rear housings to one another. The helmet and the accessory light are configured to extend from in front of the human head to behind the human head. The separation between attachment points for the accessary light at the front and rear of the helmet provides the attachment process with enough stability that it can be easily performed by the person wearing the helmet using only one hand.

Preferably, the attachment structures of the housings are attracted to the attachment structures of the helmet. For example, the attachment structures of the housing may include ferromagnetic plates, while the attachment structures of the housings include permanent magnets, forming an arrangement that allows the helmet to be made and distributed without the accessory light while an ability to attach the accessory light later is retained.

For example, the illumination source is flexible attached to extend forward from the front housing, while the rear housing holds a battery connected to the illumination source by an electrical cable extending along the central frame. The apparatus may additionally include a switch turning the illumination source on as the contact structures of the housings and the and of the helmet are brought into engagement with one another.

In accordance with yet another aspect of the invention, a kit is provided for preparing a helmet to receive attachment of the accessory light when the helmet has not been previously so prepared. The kit includes two attachment assemblies, each comprising a resilient attachment pad having a first side adhesively attached to a ferromagnetic plate and a second side, opposite the first side, having an adhesive layer covered by a peel-away release liner, The kit may additionally include the accessory light.

BRIEF DESCRIPTION OF THE FIGURES

These and other aspects of the invention will be made apparent by reading the following specification in conjunction with the accompanying drawings, in which:

FIG. 1 is a schematic cross-sectional view of a conventional helmet/hood assembly.

FIG. 2 is a schematic view of a process for preparing the conventional helmet/hood of FIG. 1 for use;

FIG. 6 is a fragmentary perspective view of the helmet/hood assembly of FIG. 3, shown as packaged for storage and shipment, and FIG. 7 is a schematic view of a process for preparing the helmet/hood assembly of FIG. 3 for use;

DETAILED DESCRIPTION OF THE INVENTION

Figure 4:
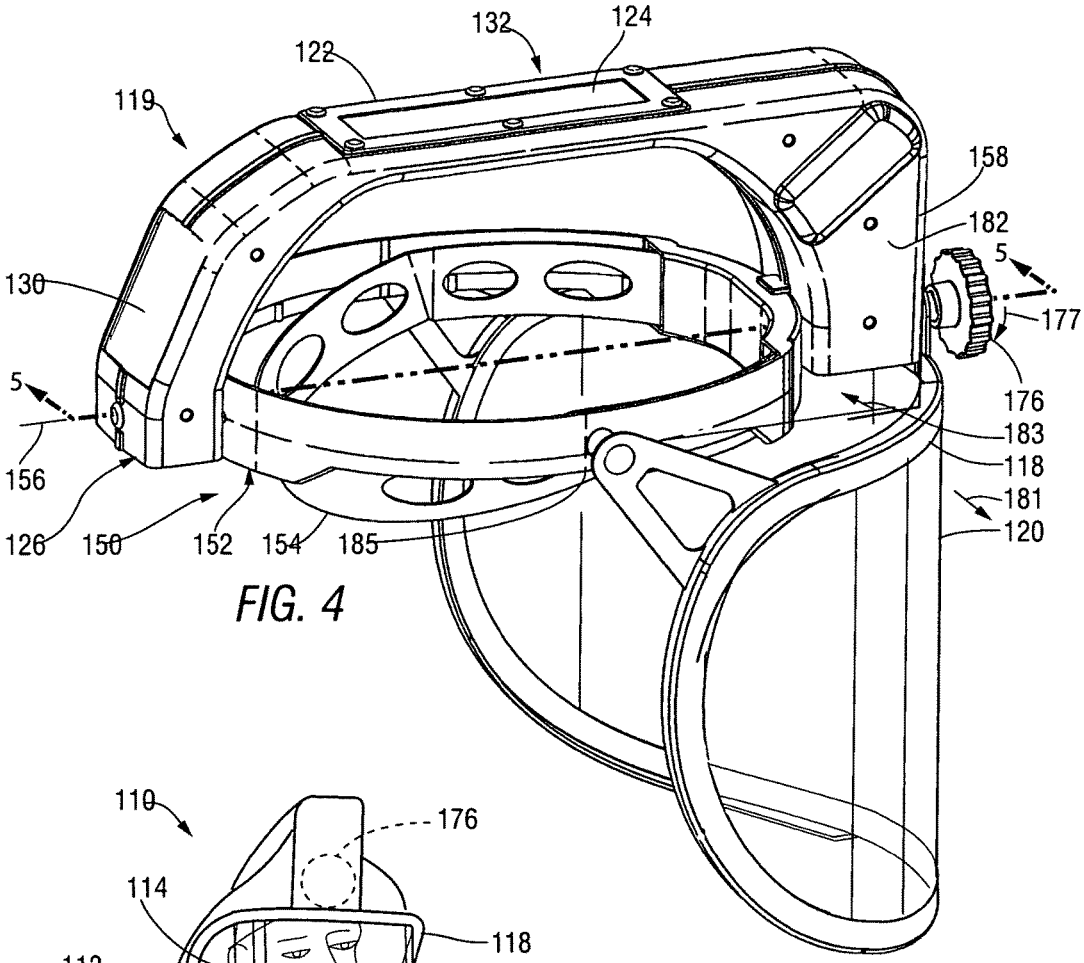
FIG. 4 is a side perspective view of the helmet/hood assembly of FIG. 3, shown with the hood removed to reveal internal structures.
Figure 3:
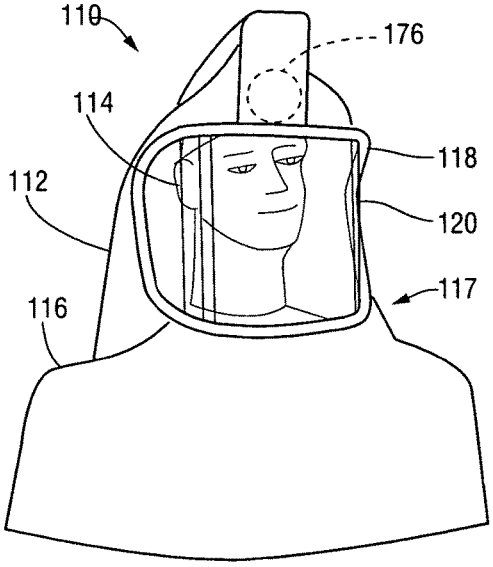
FIG. 3 is a front perspective view of a helmet/hood assembly built in accordance with the present invention.
Figure 5:
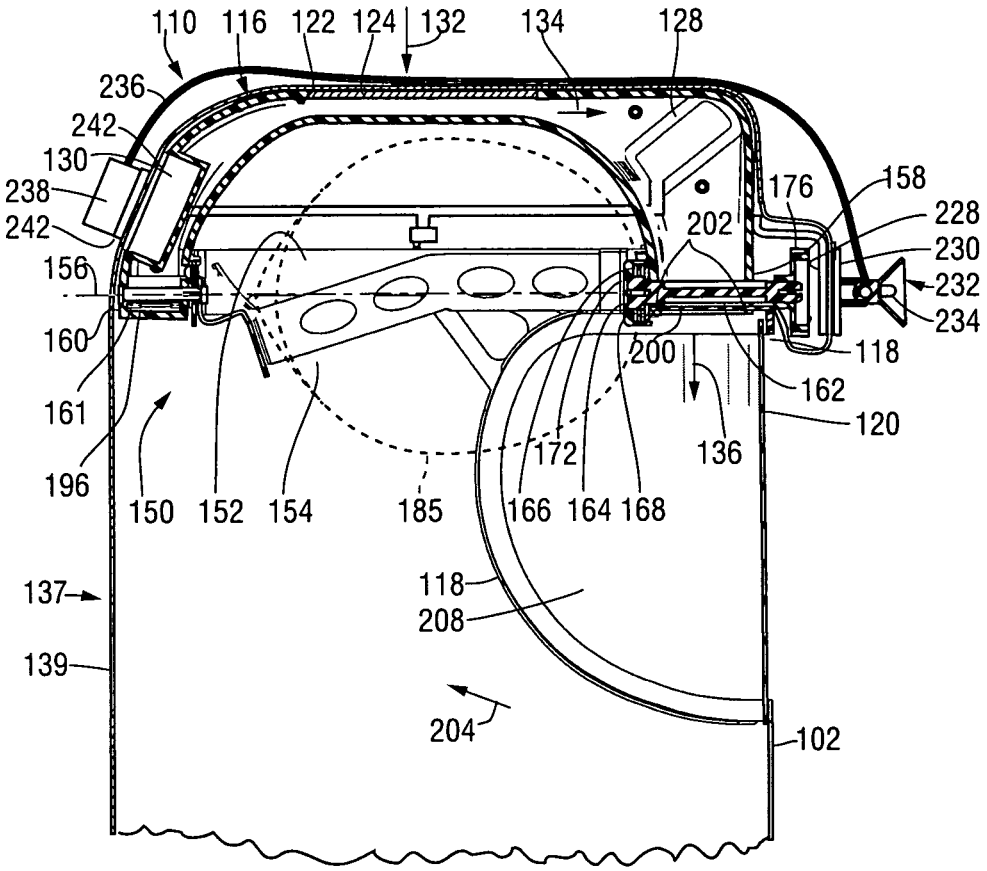
FIG. 5 is a fragmentary longitudinal cross-sectional elevation of the helmet/hood assembly of FIG. 3. taken as indicated by section lines 5-5 in FIG. 4.

FIGS. 3-5 show a helmet/hood assembly 110 including a hood 112 arranged for covering the head 114 and shoulders 116 of the wearer 118, with FIG. 3 being a perspective front view of the helmet/hood assembly 110 in place on the wearer 118, while FIG. 4 is a perspective side view of a helmet subassembly 119 within the helmet/hood assembly 110, taken from a right side thereof and from above, being shown with the hood 112 removed to reveal details of the helmet subassembly 119, and while FIG. 5 is a cross-sectional elevation of the helmet/hood assembly 110, taken as indicated by section line 5=5 in FIG. 4.

The hood 112 is fastened to a front frame 118 holding a curved transparent face shield 120 and to an upper frame 122 holding an air filter 124. As shown particularly in FIG. 5, the helmet subassembly 119 additionally includes a housing 126 holding an electric fan 128 powered by a battery 130, with the housing 126 serving as an air duct. The fan 128, which is, for example, a centrifugal flow device, pulls air inward, in the direction of arrow 132, through the filter 124, moves the air forward, in the direction of arrow 134, within the housing 126 to be exhausted downward, in the direction of arrow 136, within the hood 112 and the face shield 120. As shown in FIG. 5, the hood 112 additionally includes a posterior air outlet 137, covered by an air filter 139.

It is noted that the helmet/hood assembly 110 is configured to produce a constant flow of fresh air through the helmet/hood apparatus 110, with air being drawn through the filter 124 from a space 140 above the helmet/hood apparatus 110. The posterior air outlet 137, which is provided so that the flow of fresh air can easily be maintained. In particular, air is taken from the space 140 above the helmet/hood assembly 10 because this space, being away from the space in which blood splatter is likely to occur, is naturally free of airborne contamination, and because hospitals provide patterns of airflow to keep such spaces free from contamination. This configuration has a significant advantage over the prior art devices described above in reference to FIG. 1, which lack a provision for pulling air inward through the top of the hood. The constant flow of fresh air prevents an accumulation of carbon dioxide within the helmet hood assembly 110.

It is further noted that supplying the battery as a part of the disposable helmet/hood assembly 110 provides the present invention with significant advantages over the use of a rechargeable battery in prior art devices, as described above in reference to FIGS. 1 and 2. The difficulties of handling batteries through a recharging process are eliminated, and the helmet/hood assembly 110 becomes a becomes a self-contained electrical device with its own power source, allowing its use without additional provisions in areas where electrical power is not available, such as remote locations and disaster areas.

The helmet subassembly 119 further includes a support ring subassembly 150 for supporting the helmet/hood assembly 110 on the head 114 of the wearer 118. The support ring subassembly 150 in turn includes a support ring 152 extending loosely around the head 114 and a headband 154 that can be adjusted to extend more tightly or more loosely around the head 114. The support ring subassembly 150 is mounted to pivot within the housing 126 about a pivot axis 156 extending between a front end portion 158 of the housing 126 and the rear end portion 160 thereof, with the support ring subassembly being disposed below a central portion 161 of the housing 126. Both the front end portion 158 and the rear end portion extend downward from the central portion 161. For example, the pivot axis 156 is formed by a rear pivot pin 161, snapped in place within the rear end 160 of the housing and a front adjustment shaft 162, which holds an adjustment gear 164 in meshing engagement with an upper adjustment rack 166 and a lower adjustment rack 168. The adjustment racks 166, 168 are formed along opposite ends 170 of the headband 154, which extend in opposite directions within a slotted enclosure 172 formed to extend along the support ring 152. For example, the adjustment shaft 162 includes a central portion 173 having a cruciform cross-sectional shape.

For example, the support ring subassembly 150 is configured 54 so that, when the adjustment knob 176 is turned in the direction of arrow 177, both the upper adjustment rack 166 and the lower adjustment rack 168 are moved outward within the slotted enclosure 172, loosening the headband 154. On the other hand, when the attachment knob 176 is tuned opposite the direction of arrow 177, both the adjustment racks 166, 168 are moved inward within the slotted enclosure 172, tightening the headband 154. The adjustment gear 164 and an external adjustment knob 176 are snapped onto the adjustment shaft 162 so that the adjustment knob 176 can be used to adjust the tightness of the headband 154. The support ring subassembly 150 is pivotally attached to the housing 126, with a front opening 178 and a rear opening 180, both extending through the support ring 152, being pivotally held on the front adjustment shaft 162 and the rear pivot pin 160. Even though the adjustment knob 176 is disposed under the hood 112, it can be easily felt and used through the hood 112 without moving a hand out of the sterile field area, providing a significant advantage over the prior art devices that have adjustment knobs in the back.

FIGS. 3-5 show the helmet-hood assembly 110 with the support ring subassembly 150 in an operational position, in which it would be worn and used. Referring particularly to FIG. 4, with the support ring 150 in the operational position, the headband 154 extends outward, in a horizontal direction indicated by arrow 181 beyond a lateral side 182 of the housing 126 through a substantial distance indicated as 183. The opposite side 184 of the headband 154 additionally extends horizontally outward from a lateral side (not shown) opposite the lateral side 182 through a similar distance 183.

Referring to FIG. 5, the support ring subassembly 150 is pivoted about the pivot axis 156 through a ninety-degree angle between the operational position in which it is shown and a storage position, in which the headband 154 extends vertically, as shown by dashed lines 185 below the central portion 173 without extending outwardly beyond the lateral side 182 of the housing 126, and additionally without extending beyond the opposite lateral side (not shown) thereof. In this way, the width of the helmet/hood assembly 110 is substantially reduced for shipment and storage.

For example, moving the support ring subassembly 150 into the operational position to prepare the helmet/hood assembly for use may be used to turn the fan 128 on, with a switch 156 actuated by moving the support ring subassembly into the service position being provided within a circuit 187 connecting the fan 128 with the battery 130. In the example of FIG. 5, the switch 126 is closed by upward movement of an edgy 187*a* of the support ring 152 and held closed as long as the support ring subassembly 150 is held in the operational position.

Figure 11:
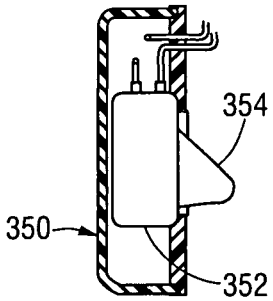
FIG. 11 is a cross-sectional elevation of an alternate accessory light showing an alternative switch therein.

FIG. 6 is a fragmentary perspective view of the helmet/hood assembly 110 within a 12.7 cm by 28 cm by 35.5 cm (5 in by 11 in by 14 in) package 188 for storage or shipment. The support ring subassembly 152 us shown as being disposed at an oblique angle, between the operational position and the storage position, allowing the depiction of details within the support ring subassembly 152. Referring to FIGS. 4 and 6, it is noted that the helmet subassembly 119 additionally includes several stabilizing members releasably holding the support ring subassembly 150 in the operational position, as shown in FIGS. 11-3, by preventing rotation of the support ring subassembly 150 about the pivot axis 156. For example, the stabilizing members include a pair of attachment structures 192 that are snapped into place on to extend inward within openings 194 at each side 195 of the support ring 152, and a detent pin 196 extending outward from a rear portion 198 of the support ring 152. When the attachment structures 192 and the detent pin 196 are not connected to their mating structures, the support assembly can be rotated in either direction between the operational position of FIGS. 4 and 5, and the storage position.

As shown in FIG. 5, the front frame 118 and the face shield 120 are attached to the housing 126 by a flexible tab 200 extending through slots 202 within the housing 126. When the attachment structures 192 and the detent pin 198 are not connected to their mating structures, the front frame 228 and the face shield 120 can be pivoted inward and upward, in the direction of arrow 204 by deflecting the flexible tab 200, reducing the space required for the front frame 118 and the face shield 120 within the package 188 Furthermore, when the attachment structures 192 are not connected with their mating structures with the support assembly in the storage of the position of FIG. 6, the opposite sides 208 of the face shield 120 are squeezed into the shape shown in FIG. 6 when the helmet/hood assembly 110 is placed in the package 188, additionally reducing the space required in the package 186.

FIG. 7 a schematic view of the flow of parts within a hospital to provide helmet/hood assemblies 110 as needed for operating room personnel. In this process, the helmet/hood assembly 119, packaged as described above in reference to FIG. 6, is received from a supplier at 210 and stored in helmet/hood assembly storage 212. When it is time to prepare the helmet/hood assembly 110 for placement on a wearer 118, in step 214, the helmet/hood assembly 110 is removed from the package 188 and the support ring subassembly 150 and the face shield 120 are aligned into the operational configuration of FIGS. 3-5. As the support ring subassembly 150 is thus rotated into position, the detent pin 196 moves into place to lock the support ring subassembly 150 in place. As the face mask 120 is additionally brought into position, the attachment structures 192 are brought into alignment with the openings 194 in each side 195 of the support ring 152 and are snapped into place within these openings 194 so that the support ring subassembly 150 and the face shield 120 are subsequently retained in the operational configuration. The helmet/hood assembly 110 is then placed on the wearer 118. When the surgical procedure has been completed, the used helmet/hood assembly 216 is removed from the wearer 118 and discarded at location 218.

The method of providing the helmet/hood assembly 110 as a single, disposable packaged unit provides the present invention with a number of significant advantages over the prior art devices described above in reference to FIGS. 1 and 2. The helmet/hood assembly 110 is easily provided and stored in sterilized packaging. There is no need to replace individual items, such as sweat bands and a face shield so that the apparatus can be reused. Concerns that infectious agents may build up within a helmet as it is used by multiple wearers and that such infections agents may be spread from one area to another as the helmet is moved around are eliminated. The process of preparing the apparatus within the hospital for use by and individual wearer is greatly simplified.

Referring again to FIG. 5, the helmet/hood assembly 110 may be optionally provided with a front helmet attachment structure 228 in a front portion of the helmet subassembly, such as on a bracket extending in front of the adjustment knob 176, while an accessory light 232 is provided with a front housing attachment structure 230. The front helmet attachment structure 228 and the front housing attachment structure 230 are attracted to one another to be held together by a magnetic field. Preferably, the front helmet attachment structure 228 includes a ferromagnetic structure, while the front housing attachment structure 230 includes a permanent magnet.

The accessory light 232 includes an electrically operated light 234, connected by an electrical cable 236 to a battery unit 238. Preferably, the helmet subassembly 119 additionally includes a rear helmet attachment structure 240 and a rear housing attachment structure 242 holding the battery unit 238 in place on the helmet/hood assembly 110. For example the third magnetically attractable plate 240 is composed of a ferromagnetic material, while the fourth magnetically attractable plate 242 is a permanent magnet. The rear helmet attachment structure 240 and the rear housing attachment structure 242 are attracted to one another to be held together by a magnetic field. Preferably, the rear helmet attachment structure 240 includes a ferromagnetic structure, while the front housing attachment structure 242 includes a permanent magnet.

Figure 8:
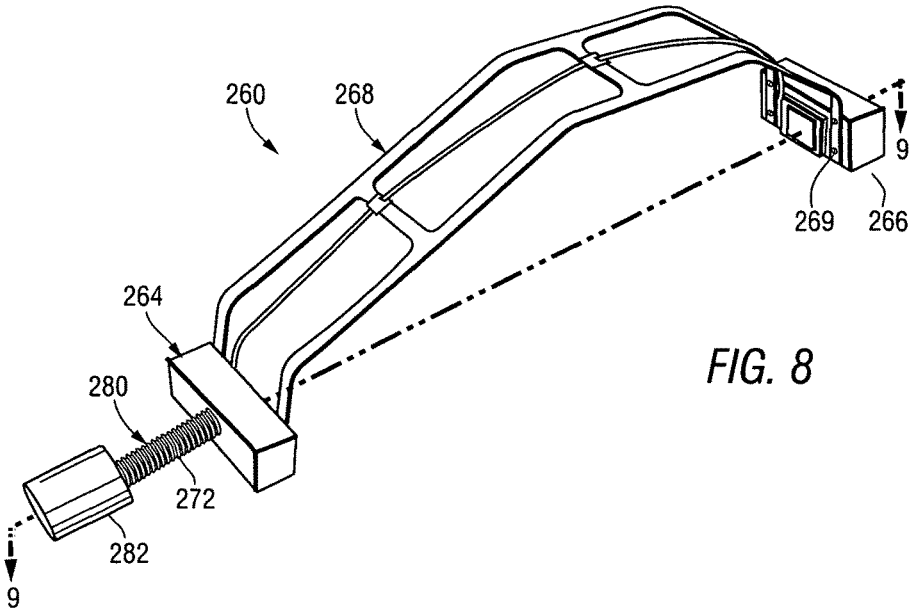
FIG. 8. Is a perspective view of an alternative accessory light.
Figure 9:
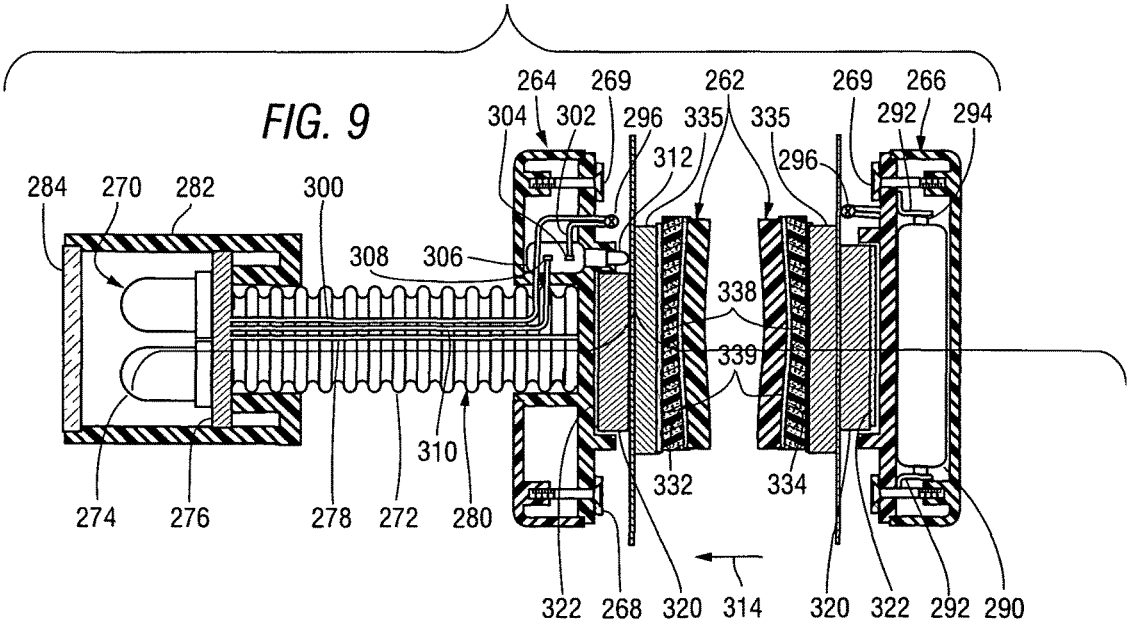
FIG. 9 is fragmentary cross-sectional plan view thereof, taken as indicated by section line 9-9 in FIG. 8.

An alternative version 260 of an accessory light will now be discussed, with reference being made to FIGS. 8 and 9. FIG. 8 is a perspective view of the alternative accessory light 260, as seen from above and in front, while FIG. 9 is a fragmentary cross-sectional pl view thereof, shown attached to a helmet/hood assembly 262. The alternative accessory light 260 includes a front housing 264 and a rear housing 266 connected to one another by a central frame 268, forming an arrangement allowing an individual wearing the helmet/hood assembly 262 to easily attach the alternative auxiliary light 260 thereto, or to remove the alternative auxiliary light 260 therefrom, using only one hand. For example, the central frame 268 is connected to the housings 264, 266 by a number of screws 269.

The front housing 264 holds an illumination source 270 by means of a flexible bellows 272. The illumination source 270 includes a number of LEDs 274 mounted on a disk-shaped circuit board 276, which is attached to the front housing 264 by means of a metal rod 278, as well as by means of the flexible bellows 272, forming an assembly 280 that is flexible with a limited resilience, allowing the illumination source 270 to be easily positioned and causing the illumination source 270 to then remain in a position in which it is placed. Furthermore, the illumination source 270 is held within a tubular structure 282 having a transparent window 284.

As shown in the example of FIG. 9, the rear housing 266 holds a number of batteries 290 and electrical contacts 292 connecting terminals 294 of the batteries 290 with one another and with an electrical cable 296 extending to the front housing 264 along the central frame 268, being attached thereto by a number of clips 298. Alternately, the rear housing 266 may include a single battery (not shown) having terminals connected by electrical contacts or directly to the electrical cable 296.

The electrical cable 296 includes a first conductor 300 that extends within the through the front housing 264 and the flexible bellows 272 to be attached to the disk-shaped circuit board 276, and a second conductor 302 connected to a first terminal 304 of a switch 306 held within the front housing 264. A second terminal 308 of the switch 306 is connected to the disk-shaped circuit board 276 by a conductor 310 extending within the front housing 264 and the flexible bellows 272. Within the disk-shaped circuit board 276, the first conductor 300 from the electrical cable 296 and the conductor 310 from the switch 306 are electrically connected to terminals of each of the illumination elements 270.

The switch 306 is configured so that, when an actuator 312 is depressed in the direction of arrow 314 by contact with the helmet 262, the switch 306 is closed, establishing an electrical connection between the first and second terminals 304, 308 of the switch 306. So that the second conductor 302 of the electrical cable 296 is electrically connected to the conductor 310 extending within the flexible bellows 272, turning the illumination sources 274 on. When the actuator 312 is then moved out of contact with the helmet 262, the actuator 312 is moved outward, opposite the direction of arrow 314 by a spring (not shown) within the switch 306, causing the electrical connection between the first and second terminals 204, 308 of the switch 306 to be broken, turning off the illumination elements 274.

Continuing to refer to FIGS. 8 and 9, and additionally referring again to FIG. 5, the alternative accessory light 260 may be attached to the helmet/hood assembly 110 as described above in reference to FIG. 5, with a front portion of the helmet/hood assembly 110 including the front helmet attachment structure 228, and with a back portion of the helmet/hood assembly 110 including the rear helmet attachment structure 240. Within the alternative accessory light 260, a housing attachment structure 320 is attached to the front housing 264 by an adhesive layer 322, while another housing attachment structure 320 is attached to the rear housing 266 by another adhesive layer 322. The housing attachment structures 320 are magnetically attractable to the front helmet attachment structures 228 240 of the helmet/hood assembly 110. Preferably, the magnetically attachable plates 228, 240 attached to the helmet/hood assembly 119 are composed of ferromagnetic materials, such as steel, while the magnetically attachable plates 320 attached to the alternative accessory light 260 are composed of a permanent magnetic material This arrangement allows the helmet/hood assembly 119 and the alternative accessory light 260 to be distributed separately, with the helmet/hood assembly 119 nevertheless allowing the alternative accessory light 260 to be attached easily later using only one hand, and additional cost and weight penalties born by a helmet/hood assembly 119 upon which the accessory light is not used being minimized.

In the example in FIG. 9, a helmet/hood assembly 262 not initially prepared for attachment of the accessory light 260 is so prepared by attaching a pair of magnetically attractable plates 335 to a front surface 332 and a rear surface 334 of the helmet/hood assembly 260 to function as helmet attachment structures 328, m340. Because these surfaces 332, 334 may be curved, each of the magnetically attachable plates 335 is preferably attached to a mounting pad 336 composed of a flexible material, such as urethane sponge, by a first adhesive layer 338, with the mounting pad being attached to one of the surfaces 332, 334 by a second adhesive layer 339.

Figure 10:
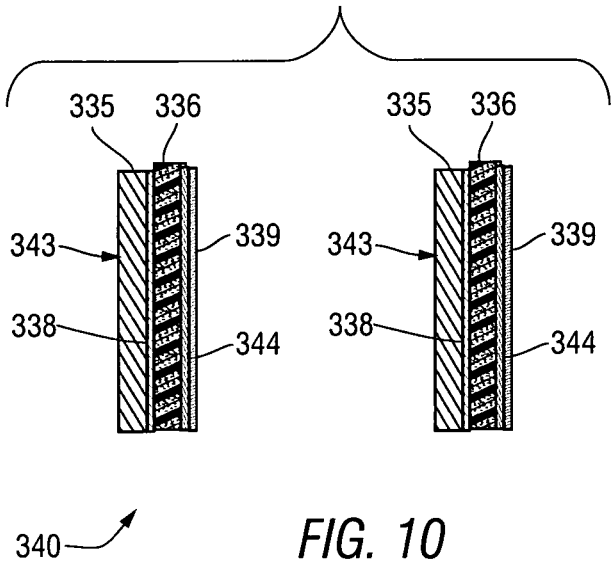
FIG. 10 is a schematic view of a kit for preparing a helmet for the attachment of an accessory light.

FIG. 10 is a schematic view of a kit 340 that is provided in accordance with a version of the invention for preparing a helmet/hood assembly 260 (shown in FIG. 9) that has not previously been prepared for the attachment of either the accessory light 232 or the alternative accessory light 260, The kit 340 includes two attachment plate assemblies 343, each of which includes a magnetically attractable plate 335 and a mounting pad 336, attached to one another by a first adhesive layer 338. A second adhesive layer 339, protected by a peel-away layer 344, is provided for attaching each attachment plate assembly 343 to the helmet/hood assembly 260.

FIG. 11 is a cross-sectional elevation of an alternative front housing 350 including an alternative switch 352 in place of the front housing 254, described above in reference to FIGS. 8 and 9. The alternative switch 352 includes a pivotally mounted actuator 354.

While the invention has been described in terms of preferred embodiments with some degree of particularity, it is understood that this description has been given only by way of example, and that many changes can be made without departing from the spirit and scope of the invention, as defined in the appended claims.

What is claimed is:

1. Apparatus comprising:

a helmet, configured to support the apparatus on a human head, including a front helmet portion with a front helmet attachment structure and a rear portion with a rear helmet attachment structure;

an accessory light including a front housing holding an illumination source powered by electricity and a front housing attachment structure, a rear housing holding a rear housing attachment structure, with a central frame extending between the front and rear housings and attaching the front and rear housings to one another, wherein the helmet and the accessory light are configured to extend from in front of the human head to behind the human head.

2. The apparatus of claim 1, wherein the helmet attachment structures are magnetically attractable to the housing attachment structures.

3. The apparatus of claim 2, wherein the helmet attachment structures are each composed of a ferromagnetic material, and wherein the housing attachment structures are each composed of a permanent magnetic material.

4. The apparatus of claim 1, additionally comprising a switch actuated to turn the illumination source on by contact with the helmet as the housing attachment structures are brought into engagement with the helmet attachment structures.

5. The apparatus of claim 1, additionally comprising a hood composed of a thin flexible sheet extending around the helmet and between the helmet attachment structures and the housing attachment structures.

6. The apparatus of claim 1, additionally comprising a resilient pad adhesively attached to each helmet attachment structure and to a surface of the helmet adjacent the helmet attachment structure.

7. The apparatus of claim 1, wherein the illumination source is flexibly attached to extend forward from the front housing.

8. The apparatus of claim 1, wherein the rear housing holds a battery, and wherein the apparatus additionally comprises an electrical cable extending along the central frame to electrically connect the illumination source with the battery.

9. An accessory light configured for attachment to a helmet, supported on a human head, wherein the accessory light includes:

a front housing holding an illumination source powered by electricity and a front housing attachment structure; and a rear housing holding a rear housing attachment structure, with a central frame extending between the front and rear housings and attaching the front and rear housings to one another, wherein the helmet and the accessory light are configured to extend from in front of the human head to behind the human head.

10. The accessory light of claim 9, wherein the housing attachment structures are magnetically attractable.

11. The accessory light of claim 10 wherein the housing attachment structures are each composed of a permanent magnetic material.

12. The accessory light of claim 9, additionally comprising a switch configured to turn the illumination source on by contact with the helmet as the housing attachment structures are brought into engagement with the helmet attachment structures.

13. The accessory light of claim 12, wherein the switch is additionally configured to turn the illumination source off when the housing attachment structures are moved away from the helmet attachment structures.

14. The accessory light of claim 9, wherein the illumination source is flexibly attached to extend forward from the front housing.

15. The accessory light of claim 9, wherein the rear housing holds a battery, and wherein the accessory light additionally comprises an electrical cable extending along the central frame to electrically conned the illumination source with the battery.

16. A kit comprising two attachment assemblies, each comprising a resilient attachment pad having a first side adhesively attached to a ferromagnetic plate and a second side, opposite the first side, having an adhesive layer covered by a peel-away release liner, and an accessory light configured for attachment to a helmet, supported on a human head, wherein the two attachment assemblies have been attached to front and rear portions of the helmet, and wherein the accessory light includes:

a front housing holding an illumination source powered by electricity and a front housing attachment structure including a first permanent magnet attractable to the attachment pads, and a rear housing holding a rear housing attachment structure including a second permanent magnet attractable to the attachment pads, with a central frame extending between the front and rear housings and attaching the front and rear housings to one another, wherein the helmet and the accessory light are configured to extend from in front of the human head to behind the human head.

17. The kit of claim 16, wherein the accessory light additionally comprises a switch configured to turn the illumination source on by contact with the helmet as the housing attachment structures are brought into engagement with the helmet attachment structures.

18. The kit of claim 16, wherein the illumination source is flexibly attached to extend forward from the front housing.

19. The kit of claim 16, wherein the rear housing holds a battery, and wherein the accessory light additionally comprises an electrical cable extending along the central frame to electrically connect the illumination source with the battery.

* * * * *